US009773507B2

(12) United States Patent
Sung et al.

(10) Patent No.: US 9,773,507 B2
(45) Date of Patent: Sep. 26, 2017

(54) APPARATUS AND METHOD FOR DETERMINING WEIGHTING FUNCTION HAVING FOR ASSOCIATING LINEAR PREDICTIVE CODING (LPC) COEFFICIENTS WITH LINE SPECTRAL FREQUENCY COEFFICIENTS AND IMMITTANCE SPECTRAL FREQUENCY COEFFICIENTS

(71) Applicant: SAMSUNG ELECTRONICS CO., LTD., Suwon-si (KR)

(72) Inventors: Ho Sang Sung, Yongin-si (KR); Eun Mi Oh, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/095,601

(22) Filed: Apr. 11, 2016

(65) Prior Publication Data

US 2016/0225380 A1 Aug. 4, 2016

Related U.S. Application Data

(63) Continuation of application No. 13/067,366, filed on May 26, 2011, now Pat. No. 9,311,926.

(30) Foreign Application Priority Data

Oct. 18, 2010 (KR) ..... 10-2010-0101305

(51) Int. Cl.
*G10L 19/07* (2013.01)
*G10L 19/08* (2013.01)
(Continued)

(52) U.S. Cl.
CPC ..... *G10L 19/06* (2013.01); *G10L 19/07* (2013.01)

(58) Field of Classification Search
CPC ..... G10L 19/02; G10L 19/04; G10L 19/07; G10L 25/12; G10L 25/15; G10L 19/08
(Continued)

(56) References Cited

U.S. PATENT DOCUMENTS 5,448,680 A * 9/1995 Kang ..... G10L 19/07 704/200
5,737,484 A 4/1998 Ozawa
(Continued)

FOREIGN PATENT DOCUMENTS

CN 1677493 A 10/2005
EP 0 899 720 A2 3/1999
(Continued)

OTHER PUBLICATIONS

"Frame error robust narrow-band and wideband embedded variable bit-rate coding of speech and audio from 8-32 kbit/s", Series G: Transmission Systems and Media, Digital Systems and Networks, International Telecommunication Union, Jun. 30, 2008, 257 pages total, XP055087883.
(Continued)

*Primary Examiner* — Martin Lerner
(74) *Attorney, Agent, or Firm* — Sughrue Mion, PLLC

(57) ABSTRACT

Proposed is a method and apparatus for determining a weighting function for quantizing a linear predictive coding (LPC) coefficient and having a low complexity. The weighting function determination apparatus may convert an LPC coefficient of a mid-subframe of an input signal to one of a immittance spectral frequency (ISF) coefficient and a line spectral frequency (LSF) coefficient, and may determine a weighting function associated with an importance of the ISF coefficient or the LSF coefficient based on the converted ISF coefficient or LSF coefficient.

8 Claims, 12 Drawing Sheets

(51) Int. Cl.
*G10L 25/15* (2013.01)
*G10L 19/06* (2013.01)

(58) Field of Classification Search
USPC ..... 704/205, 206, 209, 219, 500, 501
See application file for complete search history.

(56) References Cited

U.S. PATENT DOCUMENTS

| | | | | |
|---|---|---|---|---|
| 5,754,733 | A | 5/1998 | Gardner et al. | |
| 5,778,334 | A | 7/1998 | Ozawa et al. | |
| 6,122,608 | A | 9/2000 | McCree | |
| 6,131,083 | A | 10/2000 | Miseki et al. | |
| 6,826,526 | B1 * | 11/2004 | Norimatsu | G10L 19/038 704/222 |
| 6,889,185 | B1 | 5/2005 | McCree | |
| 6,988,067 | B2 | 1/2006 | Kim et al. | |
| 7,003,454 | B2 | 2/2006 | Ramo | |
| 7,392,179 | B2 | 6/2008 | Yasunaga et al. | |
| 7,493,255 | B2 | 2/2009 | Al-Naimi et al. | |
| 7,516,066 | B2 | 4/2009 | Schuijers et al. | |
| 8,977,543 | B2 * | 3/2015 | Sung | G10L 19/06 704/200 |
| 8,977,544 | B2 * | 3/2015 | Sung | G10L 19/06 704/201 |
| 9,236,059 | B2 * | 1/2016 | Sung | G10L 19/07 |
| 9,311,926 | B2 * | 4/2016 | Sung | G10L 19/07 |
| 2001/0010038 | A1 | 7/2001 | Kang et al. | |
| 2002/0038325 | A1 | 3/2002 | Van Den Enden et al. | |
| 2002/0052737 | A1 | 5/2002 | Kim et al. | |
| 2004/0006463 | A1 | 1/2004 | Al-Naimi et al. | |
| 2004/0015346 | A1 | 1/2004 | Yasunaga et al. | |
| 2004/0042622 | A1 | 3/2004 | Saito | |
| 2004/0111257 | A1 | 6/2004 | Sung et al. | |
| 2005/0065787 | A1 | 3/2005 | Stachurski | |
| 2005/0114123 | A1 | 5/2005 | Lukac et al. | |
| 2006/0074643 | A1 | 4/2006 | Lee et al. | |
| 2007/0061135 | A1 | 3/2007 | Chu et al. | |
| 2007/0150271 | A1 * | 6/2007 | Virette | G10L 19/002 704/230 |
| 2008/0059166 | A1 | 3/2008 | Ehara | |
| 2008/0126084 | A1 | 5/2008 | Lee et al. | |
| 2008/0195381 | A1 | 8/2008 | Soong et al. | |
| 2009/0012780 | A1 | 1/2009 | Murashima | |
| 2009/0141790 | A1 | 6/2009 | Kawashima et al. | |
| 2009/0299738 | A1 | 12/2009 | Sato et al. | |
| 2011/0295600 | A1 * | 12/2011 | Sung | G10L 19/07 704/219 |
| 2012/0095756 | A1 * | 4/2012 | Sung | G10L 19/06 704/219 |
| 2012/0271629 | A1 * | 10/2012 | Sung | G10L 19/06 704/219 |
| 2012/0278069 | A1 * | 11/2012 | Sung | G10L 19/06 704/219 |
| 2015/0162016 | A1 * | 6/2015 | Sung | G10L 19/06 704/219 |
| 2015/0162017 | A1 * | 6/2015 | Sung | G10L 19/06 704/219 |
| 2016/0111106 | A1 * | 4/2016 | Sung | G10L 19/07 704/501 |

FOREIGN PATENT DOCUMENTS

| | | | |
|---|---|---|---|
| EP | 1 852 851 | A1 | 11/2007 |
| JP | 8-44398 | A | 2/1996 |
| JP | 8-234797 | A | 9/1996 |
| JP | 10-124092 | | 5/1998 |
| JP | 10-276095 | | 10/1998 |
| JP | 11-143498 | A | 5/1999 |
| KR | 1999-023932 | | 3/1999 |
| KR | 1999-0036044 | | 5/1999 |
| KR | 2003-0094538 | A | 12/2003 |
| KR | 10-2004-0102152 | | 12/2004 |
| KR | 10-2005-0020728 | A | 3/2005 |
| KR | 10-2006-0027117 | | 3/2006 |
| KR | 10-2006-0067016 | | 6/2006 |
| KR | 10-2008-0023618 | | 3/2008 |
| KR | 10-2008-0074234 | | 8/2008 |
| KR | 10-2008-0093450 | | 10/2008 |
| KR | 10-2011-0130290 | | 12/2011 |

OTHER PUBLICATIONS

Communication dated Mar. 10, 2015 issued by the Japanese Patent Office in counterpart Japanese Patent Application No. 2013-534808.
Communication dated May 6, 2015 issued by the State Intellectual Property Office of P.R. China in counterpart Chinese Patent Application No. 201180661021.9.
Yoshinori Morita, et al; "Vector Quantization of LSP Parameters Using Feedforward Neural Network and Considering Spectrum Envelope"; The Institute of Electronics, Information, and Communication Engineers; Jul. 1998; pp. 23-28.
Communciation dated Jun. 10, 2014 issued by the Japanese Patent Office in coutnerpart Japanese Application No. 2013-534808.
Communication dated Jun. 27, 2014 issed by the Mexican Institute of Industrial Property in counterpart Mexican Application No. MX/a/2014/004356.
Communication dated Jul. 2, 2014 issued by State Intellectual Property Office of P.R China in counterpart Chinese application No. 201180061021.9.
Communication dated Jul. 29, 2014 issued by European Patent Office in counterpart European application No. 11834598.2.
Dong-il Chang, et al. "Efficient Quantization of LSF Parameters Using Classified SVQ Combined with Conditional Splitting", 1995 International Conference on Acoustics, Speech, and Signal Processing, vol. 1, May 9-12 1995, pp. 736-739, XP010625338.
International Search Report mailed Apr. 24, 2012 issued in corresponding Korean Patent Application No. PCT/KR2011/007738.
Communication issued Feb. 26, 2016 by the European Patent Office in counterpart European Application No. 16150075.6.
Communication issued Mar. 7, 2016 by the Korean Intellectual Property Office in counterpart Korean Application No. 10-2010-0101305.
Communication dated Jun. 20, 2017 issued by the Japanese Patent Office in counterpart Japanese Patent Application No. 2016-077549.
Communication dated Jun. 9, 2017 issued by the Korean Intellectual Property Office in counterpart Korean Application No. 10-2017-0072722.

* cited by examiner

APPARATUS AND METHOD FOR DETERMINING WEIGHTING FUNCTION HAVING FOR ASSOCIATING LINEAR PREDICTIVE CODING (LPC) COEFFICIENTS WITH LINE SPECTRAL FREQUENCY COEFFICIENTS AND IMMITTANCE SPECTRAL FREQUENCY COEFFICIENTS

CROSS-REFERENCE TO RELATED APPLICATIONS

This is a Continuation Application of U.S. application Ser. No. 13/067,366 filed May 26, 2011, now U.S. Pat. No. 9,311,926 issued Apr. 12, 2016, which claims the priority benefit of Korean Patent Application No. 10-2010-0101305, filed on Oct. 18, 2010, in the Korean Intellectual Property Office; the entire disclosures of the prior applications are considered part of the disclosure of the accompanying continuation application, and are hereby incorporated by reference.

BACKGROUND

1. Field

Embodiments relate to an apparatus and method for determining a weighting function for a linear predictive coding (LPC) coefficient quantization, and more particularly, to an apparatus and method for determining a weighting function having a low complexity in order to enhance a quantization efficiency of an LPC coefficient in a linear prediction technology.

2. Description of the Related Art

In a conventional art, linear predictive encoding has been applied to encode a speech signal and an audio signal. A code excited linear prediction (CELP) encoding technology has been employed for linear prediction. The CELP encoding technology may use an excitation signal and a linear predictive coding (LPC) coefficient with respect to an input signal. When encoding the input signal, the LPC coefficient may be quantized. However, quantizing of the LPC may have a narrowing dynamic range and may have difficulty in verifying a stability.

In addition, a codebook index for recovering an input signal may be selected in the encoding. When all the LPC coefficients are quantized using the same importance, a deterioration may occur in a quality of a finally generated input signal. That is, since all the LPC coefficients have a different importance, a quality of the input signal may be enhanced when an error of an important LPC coefficient is small. However, when the quantization is performed by applying the same importance without considering that the LPC coefficients have a different importance, the quality of the input signal may be deteriorated.

Accordingly, there is a desire for a method that may effectively quantize an LPC coefficient and may enhance a quality of a synthesized signal when recovering an input signal using a decoder. In addition, there is a desire for a technology that may have an excellent coding performance in a similar complexity.

SUMMARY

According to an aspect of one or more embodiments, there is provided an encoding apparatus for enhancing a quantization efficiency in linear predictive encoding, the apparatus including a first converter to convert a linear predictive coding (LPC) coefficient of a mid-subframe of an input signal to one of a line spectral frequency (LSF) coefficient and an immittance spectral frequency (ISF) coefficient; a weighting function determination unit to determine a weighting function associated with an importance of the LPC coefficient of the mid-subframe using the converted ISF coefficient or LSF coefficient; a quantization unit to quantize the converted ISF coefficient or LSF coefficient using the determined weighting function; and a second coefficient converter to convert the quantized ISF coefficient or LSF coefficient to a quantized LPC coefficient using at least one processor, wherein the quantized LPC coefficient is output to an encoder of the encoding apparatus.

The weighting function determination unit may determine a weighting function with respect to the ISF coefficient or the LSF coefficient, based on an interpolated spectrum magnitude corresponding to a frequency of the ISF coefficient or the LSF coefficient converted from the LPC coefficient.

The weighting function determination unit may determine a weighting function with respect to the ISF coefficient or the LSF coefficient, based on an LPC spectrum magnitude corresponding to a frequency of the ISF coefficient or the LSF coefficient converted from the LPC coefficient.

According to an aspect of one or more embodiments, there is provided an encoding method for enhancing a quantization efficiency in linear predictive encoding, the method including converting a linear predictive coding (LPC) coefficient of a mid-subframe of an input signal to one of a line spectral frequency (LSF) coefficient and an immittance spectral frequency (ISF) coefficient; determining a weighting function associated with an importance of the LPC coefficient of the mid-subframe using the converted ISF coefficient or LSF coefficient; quantizing the converted ISF coefficient or LSF coefficient using the determined weighting function; and converting the quantized ISF coefficient or LSF coefficient to a quantized LPC coefficient using at least one processor, wherein the quantized LPC coefficient is output to an encoder.

The determining may include determining a weighting function with respect to the ISF coefficient or the LSF coefficient, based on an interpolated spectrum magnitude corresponding to a frequency of the ISF coefficient or the LSF coefficient converted from the LPC coefficient.

The determining may include determining a weighting function with respect to the ISF coefficient or the LSF coefficient, based on an LPC spectrum magnitude corresponding to a frequency of the ISF coefficient or the LSF coefficient converted from the LPC coefficient.

According to one or more embodiments, it is possible to enhance a quantization efficiency of an LPC coefficient by converting the LPC coefficient to an ISF coefficient or an LSF coefficient and thereby quantizing the LPC coefficient.

According to one or more embodiments, it is possible to enhance a quality of a synthesized signal based on an importance of an LPC coefficient by determining a weighting function associated with the importance of the LPC coefficient.

According to one or more embodiments, it is possible to enhance a quality of an input signal by interpolating a weighting function for quantizing an LPC coefficient of a current frame and an LPC coefficient of a previous frame in order to quantize an LPC coefficient of a mid-subframe.

According to one or more embodiments, it is possible to enhance a quantization efficiency of an LPC coefficient, and to accurately induce a weight of the LPC coefficient by combining a per-magnitude weighting function and a per-frequency weighting function. The per-magnitude weighting function indicates that an ISF or an LSF substantially affects a spectrum envelope of an input signal. The per-frequency weighting function may use a perceptual characteristic in a frequency domain and a formant distribution.

According to an aspect of one or more embodiments, there is provided an encoding apparatus for enhancing a quantization efficiency in linear predictive encoding, the apparatus including a weighting function determination unit to determine a weighting function associated with an importance of a linear predictive coding (LPC) coefficient of a mid-subframe of an input signal using an immittance spectral frequency (ISF) coefficient or a line spectral frequency (LSF) coefficient corresponding to the LPC coefficient; a quantization unit to quantize the converted ISF coefficient or LSF coefficient using the determined weighting function; and a second coefficient converter to convert the quantized ISF coefficient or LSF coefficient to a quantized LPC coefficient, wherein the quantized LPC coefficient is output to an encoder of the encoding apparatus.

According to an aspect of one or more embodiments, there is provided an encoding method for enhancing a quantization efficiency in linear predictive encoding, the method including determining a weighting function associated with an importance of a linear predictive coding (LPC) coefficient of a mid-subframe of an input signal using an immittance spectral frequency (ISF) coefficient or a line spectral frequency (LSF) coefficient corresponding to the LPC coefficient; quantizing the converted ISF coefficient or LSF coefficient using the determined weighting function; and converting the quantized ISF coefficient or LSF coefficient to a quantized LPC coefficient, wherein the quantized LPC coefficient is output to an encoder.

According to another aspect of one or more embodiments, there is provided at least one non-transitory computer readable medium storing computer readable instructions to implement methods of one or more embodiments.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
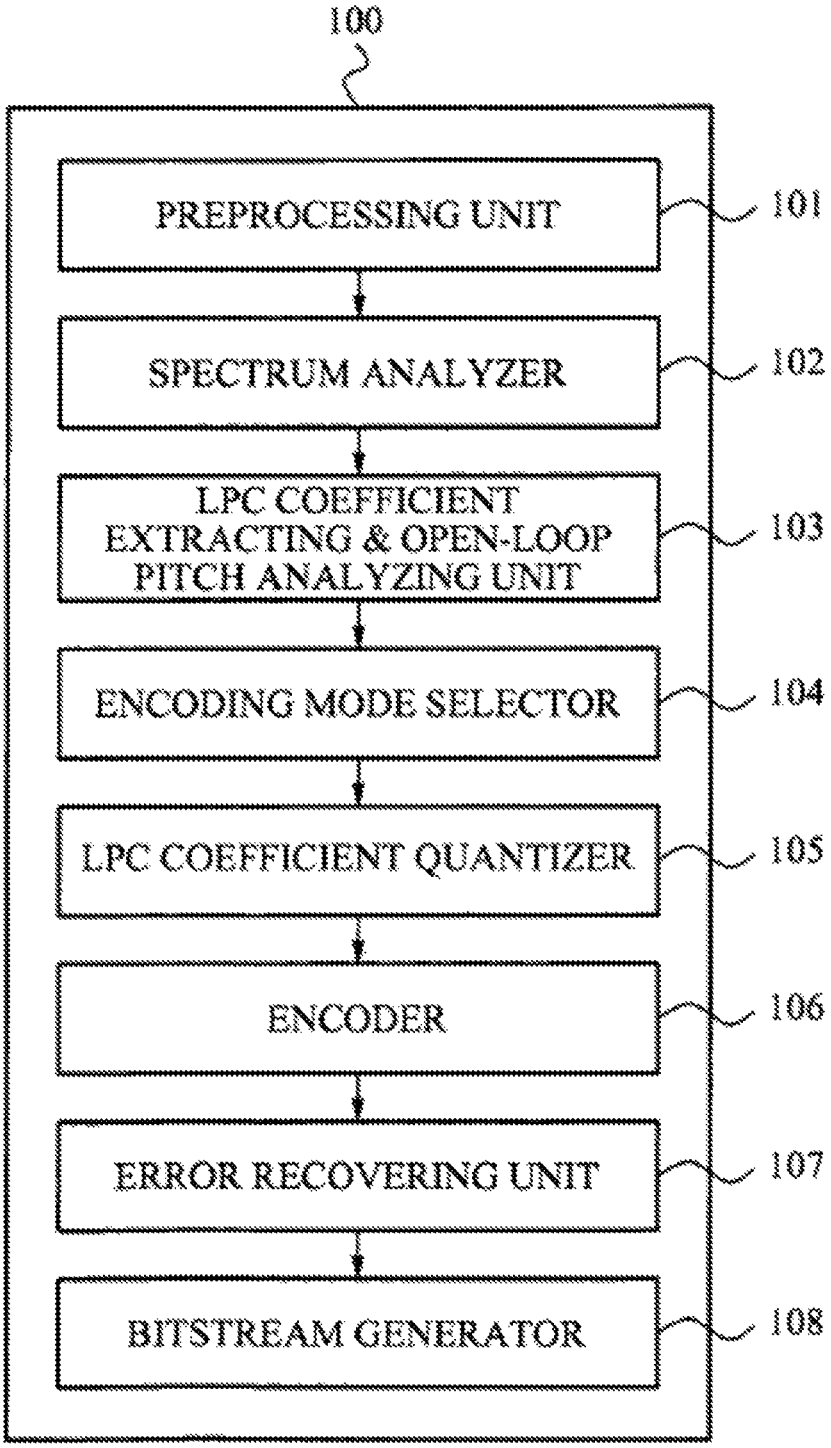
FIG. 1 illustrates a configuration of an audio signal encoding apparatus according to one or more embodiments.

Reference will now be made in detail to embodiments, examples of which are illustrated in the accompanying drawings, wherein like reference numerals refer to the like elements throughout. Embodiments are described below to explain the present disclosure by referring to the figures.

FIG. 1 illustrates a configuration of an audio signal encoding apparatus 100 according to one or more embodiments.

Referring to FIG. 1, the audio signal encoding apparatus 100 may include a preprocessing unit 101, a spectrum analyzer 102, a linear predictive coding (LPC) coefficient extracting and open-loop pitch analyzing unit 103, an encoding mode selector 104, an LPC coefficient quantizer 105, an encoder 106, an error recovering unit 107, and a bitstream generator 108. The audio signal encoding apparatus 100 may be applicable to a speech signal.

The preprocessing unit 101 may preprocess an input signal. Through preprocessing, a preparation of the input signal for encoding may be completed. Specifically, the preprocessing unit 101 may preprocess the input signal through high pass filtering, pre-emphasis, and sampling conversion.

The spectrum analyzer 102 may analyze a characteristic of a frequency domain with respect to the input signal through a time-to-frequency mapping process. The spectrum analyzer 102 may determine whether the input signal is an active signal or a mute through a voice activity detection process. The spectrum analyzer 102 may remove background noise in the input signal.

The LPC coefficient extracting and open-loop pitch analyzing unit 103 may extract an LPC coefficient through a linear prediction analysis of the input signal. In general, the linear prediction analysis is performed once per frame, however, may be performed at least twice for an additional voice enhancement. In this case, a linear prediction for a frame-end that is an existing linear prediction analysis may be performed for a one time, and a linear prediction for a mid-subframe for a sound quality enhancement may be additionally performed for a remaining time. A frame-end of a current frame indicates a last subframe among subframes constituting the current frame, a frame-end of a previous frame indicates a last subframe among subframes constituting the last frame.

A mid-subframe indicates at least one subframe present among subframes between the last subframe that is the frame-end of the previous frame and the last subframe that is the frame-end of the current frame. Accordingly, the LPC coefficient extracting and open-loop pitch analyzing unit 103 may extract a total of at least two sets of LPC coefficients.

The LPC coefficient extracting and open-loop pitch analyzing unit 103 may analyze a pitch of the input signal through an open loop. Analyzed pitch information may be used for searching for an adaptive codebook.

The encoding mode selector 104 may select an encoding mode of the input signal based on pitch information, analysis information of the frequency domain, and the like. For example, the input signal may be encoded based on the encoding mode that is classified into a generic mode, a voiced mode, an unvoiced mode, or a transition mode.

The LPC coefficient quantizer 105 may quantize an LPC coefficient extracted by the LPC coefficient extracting and open-loop pitch analyzing unit 103. The LPC coefficient quantizer 105 will be further described with reference to FIG. 2 through FIG. 9.

The encoder 106 may encode an excitation signal of the LPC coefficient based on the selected encoding module. Parameters for encoding the excitation signal of the LPC coefficient may include an adaptive codebook index, an adaptive codebook again, a fixed codebook index, a fixed codebook gain, and the like. The encoder 106 may encode the excitation signal of the LPC coefficient based on a subframe unit.

When an error occurs in a frame of the input signal, the error recovering unit 107 may extract side information for total sound quality enhancement by recovering or hiding the frame of the input signal.

The bitstream generator 108 may generate a bitstream using the encoded signal. In this instance, the bitstream may be used for storage or transmission.

Figure 2:
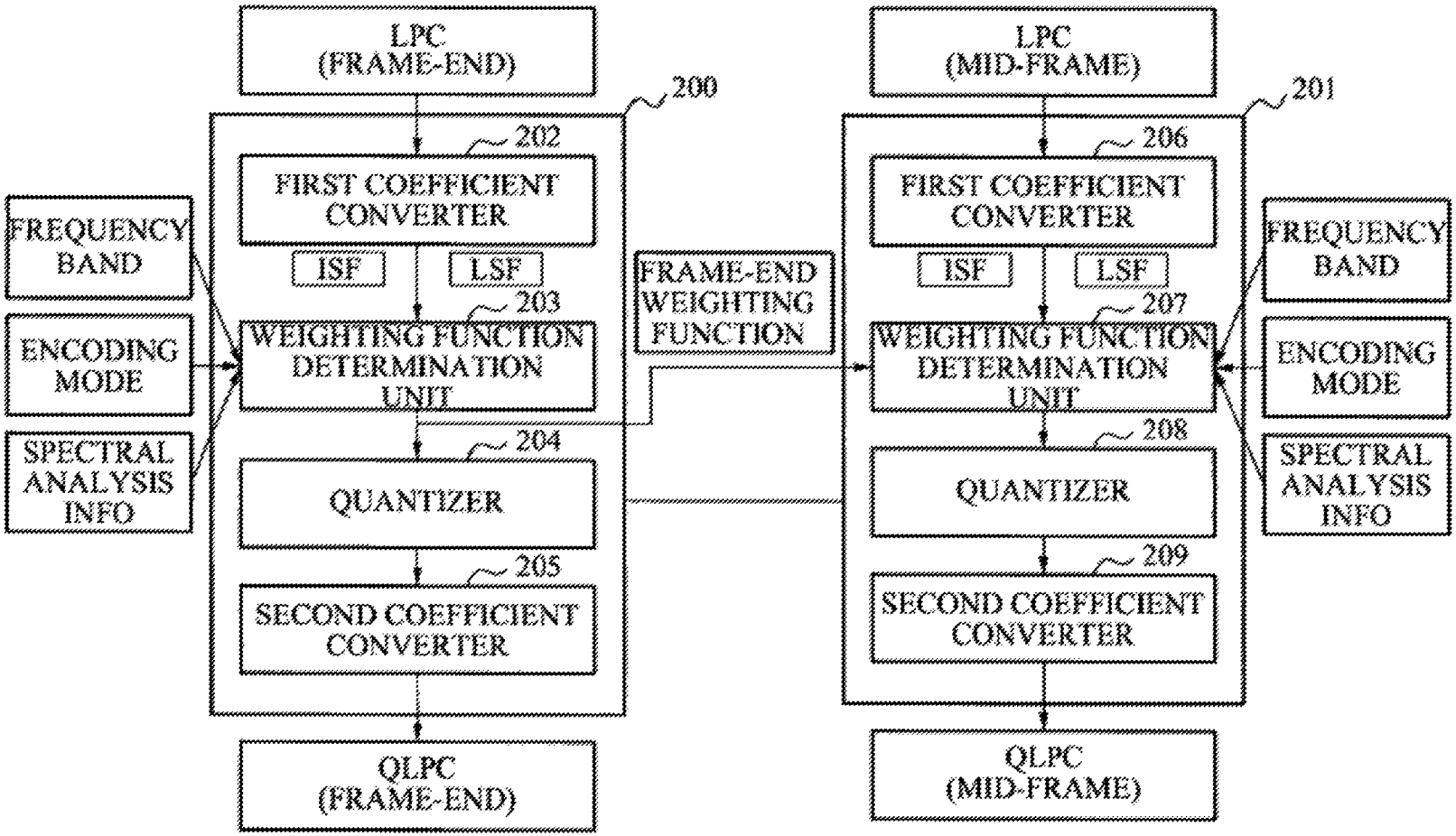
FIG. 2 illustrates a configuration of a linear predictive coding (LPC) coefficient quantizer according to one or more embodiments.

FIG. 2 illustrates a configuration of an LPC coefficient quantizer according to one or more embodiments.

Referring to FIG. 2, a quantization process including two operations may be performed. One operation relates to performing of a linear prediction for a frame-end of a current frame or a previous frame. Another operation relates to performing of a linear prediction for a mid-subframe for a sound quality enhancement.

An LPC coefficient quantizer 200 with respect to the frame-end of the current frame or the previous frame may include a first coefficient converter 202, a weighting function determination unit 203, a quantizer 204, and a second coefficient converter 205.

The first coefficient converter 202 may convert an LPC coefficient that is extracted by performing a linear prediction analysis of the frame-end of the current frame or the previous frame of the input signal. For example, the first coefficient converter 202 may convert, to a format of one of a line spectral frequency (LSF) coefficient and an immittance spectral frequency (ISF) coefficient, the LPC coefficient with respect to the frame-end of the current frame or the previous frame. The ISF coefficient or the LSF coefficient indicates a format that may more readily quantize the LPC coefficient.

The weighting function determination unit 203 may determine a weighting function associated with an importance of the LPC coefficient with respect to the frame-end of the current frame and the frame-end of the previous frame, based on the ISF coefficient or the LSF coefficient converted from the LPC coefficient. For example, the weighting function determination unit 203 may determine a per-magnitude weighting function and a per-frequency weighting function. The weighting function determination unit 203 may determine a weighting function based on at least one of a frequency band, an encoding mode, and spectral analysis information.

For example, the weighting function determination unit 203 may induce an optimal weighting function for each encoding mode. The weighting function determination unit 203 may induce an optimal weighting function based on a frequency band of the input signal. The weighting function determination unit 203 may induce an optimal weighting function based on frequency analysis information of the input signal. The frequency analysis information may include spectrum tilt information.

The weighting function for quantizing the LPC coefficient of the frame-end of the current frame, and the weighting function for quantizing the LPC coefficient of the frame-end of the previous frame that are induced using the weighting function determination unit 203 may be transferred to a weighting function determination unit 207 in order to determine a weighting function for quantizing an LPC coefficient of a mid-subframe.

An operation of the weighting function determination unit 203 will be further described with reference to FIG. 4 and FIG. 8.

The quantizer 204 may quantize the converted ISF coefficient or LSF coefficient using the weighting function with respect to the ISF coefficient or the LSF coefficient that is converted from the LPC coefficient of the frame-end of the current frame or the LPC coefficient of the frame-end of the previous frame. As a result of quantization, an index of the quantized ISF coefficient or LSF coefficient with respect to the frame-end of the current frame or the frame-end of the previous frame may be induced.

The second converter 205 may converter the quantized ISF coefficient or the quantized LSF coefficient to the quantized LPC coefficient. The quantized LPC coefficient that is induced using the second coefficient converter 205 may indicate not simple spectrum information but a reflection coefficient and thus, a fixed weight may be used.

Referring to FIG. 2, an LPC coefficient quantizer 201 with respect to the mid-subframe may include a first coefficient converter 206, the weighting function determination unit 207, a quantizer 208, and a second coefficient converter 209.

The first coefficient converter 206 may convert an LPC coefficient of the mid-subframe to one of an ISF coefficient or an LSF coefficient.

The weighting function determination unit 207 may determine a weighting function associated with an importance of the LPC coefficient of the mid-subframe using the converted ISF coefficient or LSF coefficient.

For example, the weighting function determination unit 207 may determine a weighting function for quantizing the LPC coefficient of the mid-subframe by interpolating a parameter of a current frame and a parameter of a previous frame. Specifically, the weighting function determination unit 207 may determine the weighting function for quantizing the LPC coefficient of the mid-subframe by interpolating a first weighting function for quantizing an LPC coefficient of a frame-end of the previous frame and a second weighting function for quantizing an LPC coefficient of a frame-end of the current frame.

The weighting function determination unit 207 may perform an interpolation using at least one of a linear interpolation and a nonlinear interpolation. For example, the weighting function determination unit 207 may perform one of a scheme of applying both the linear interpolation and the nonlinear interpolation to all orders of vectors, a scheme of differently applying the linear interpolation and the nonlinear interpolation for each sub-vector, and a scheme of differently applying the linear interpolation and the nonlinear interpolation depending on each LPC coefficient.

The weighting function determination unit 207 may perform the interpolation using all of the first weighting function with respect to the frame-end of the current frame and the second weighting function with respect to the frame-end of the previous end, and may also perform the interpolation by analyzing an equation for inducing a weighting function and by employing a portion of constituent elements. For example, using the interpolation, the weighting function determination unit 207 may obtain spectrum information used to determine a per-magnitude weighting function.

As one example, the weighting function determination unit 207 may determine a weighting function with respect to the ISF coefficient or the LSF coefficient, based on an interpolated spectrum magnitude corresponding to a frequency of the ISF coefficient or the LSF coefficient converted from the LPC coefficient. The interpolated spectrum magnitude may correspond to a result obtained by interpolating a spectrum magnitude of the frame-end of the current frame and a spectrum magnitude of the frame-end of the previous frame. Specifically, the weighting function determination unit 207 may determine the weighting function with respect to the ISF coefficient or the LSF coefficient, based on a spectrum magnitude corresponding to a frequency of the ISF coefficient or the LSF coefficient converted from the LPC coefficient and a neighboring frequency of the frequency. The weighting function determination unit 207 may determine the weighting function based on a maximum value, a mean, or an intermediate value of the spectrum magnitude corresponding to the frequency of the ISF coefficient or the LSF coefficient converted from the LPC coefficient and the neighboring frequency of the frequency.

A process of determining the weighting function using the interpolated spectrum magnitude will be described with reference to FIG. 5.

As another example, the weighting function determination unit 207 may determine a weighting function with respect to the ISF coefficient or the LSF coefficient, based on an LPC spectrum magnitude corresponding to a frequency of the ISF coefficient or the LSF coefficient converted from the LPC coefficient. The LPC spectrum magnitude may be determined based on an LPC spectrum that is frequency converted from the LPC coefficient of the mid-subframe. Specifically, the weighting function determination unit 207 may determine the weighting function with respect to the ISF coefficient or the LSF coefficient, based on a spectrum magnitude corresponding to a frequency of the ISF coefficient or the LSF coefficient converted from the LPC coefficient and a neighboring frequency of the frequency. The weighting function determination unit 207 may determine the weighting function based on a maximum value, a mean, or an intermediate value of the spectrum magnitude corresponding to the frequency of the ISF coefficient or the LSF coefficient converted from the LPC coefficient and the neighboring frequency of the frequency.

A process of determining the weighting function with respect to the mid-subframe using the LPC spectrum magnitude will be further described with reference to FIG. 8.

The weighting function determination unit 207 may determine a weighting function based on at least one of a frequency band of the mid-subframe, encoding mode information, and frequency analysis information. The frequency analysis information may include spectrum tilt information.

The weighting function determination unit 207 may determine a final weighting function by combining a per-magnitude weighting function and per-frequency weighting function that are determined based on at least one of an LPC spectrum magnitude and an interpolated spectrum magnitude. The per-frequency weighting function may be a weighting function corresponding to a frequency of the ISF coefficient or the LSF coefficient that is converted from the LPC coefficient of the mid-subframe. The per-frequency weighting function may be expressed by a bark scale.

The quantizer 208 may quantize the converted ISF coefficient or LSF coefficient using the weighting function with respect to the ISF coefficient or the LSF coefficient that is converted from the LPC coefficient of the mid-subframe. As a result of quantization, an index of the quantized ISF coefficient or LSF coefficient with respect to the mid-subframe may be induced.

The second converter 209 may convert the quantized ISF coefficient or the quantized LSF coefficient to the quantized LPC coefficient. The quantized LPC coefficient that is induced using the second coefficient converter 209 may indicate not simple spectrum information but a reflection coefficient and thus, a fixed weight may be used.

Hereinafter, a relationship between an LPC coefficient and a weighting function will be further described.

One of technologies available when encoding a speech signal and an audio signal in a time domain may include a linear prediction technology. The linear prediction technology indicates a short-term prediction. A linear prediction result may be expressed by a correlation between adjacent samples in the time domain, and may be expressed by a spectrum envelope in a frequency domain.

The linear prediction technology may include a code excited linear prediction (CELP) technology. A voice encoding technology using the CELP technology may include G.729, an adaptive multi-rate (AMR), an AMR-wideband (WB), an enhanced variable rate codec (EVRC), and the like. To encode a speech signal and an audio signal using the CELP technology, an LPC coefficient and an excitation signal may be used.

The LPC coefficient may indicate the correlation between adjacent samples, and may be expressed by a spectrum peak. When the LPC coefficient has an order of 16, a correlation between a maximum of 16 samples may be induced. An order of the LPC coefficient may be determined based on a bandwidth of an input signal, and may be generally determined based on a characteristic of a speech signal. A major vocalization of the input signal may be determined based on a magnitude and a position of a formant. To express the formant of the input signal, 10 orders of an LPC coefficient may be used with respect to an input signal of 300 to 3400 Hz that is a narrowband. 16 to 20 orders of LPC coefficients may be used with respect to an input signal of 50 to 7000 Hz that is a wideband.

A synthesis filter H(z) may be expressed by Equation 1.

$$H(z) = \frac{1}{A(z)} = \frac{1}{1 - \sum_{j=1}^{p} a_j z^{-j}},\ p = 10 \text{ or } 16\sim20 \qquad \text{[Equation 1]}$$

where $a_j$ denotes the LPC coefficient and p denotes the order of the LPC coefficient.

A synthesized signal synthesized by a decoder may be expressed by Equation 2.

$$\hat{S}(n) = \hat{u}(n) - \sum_{i=1}^{p} \hat{a}_i \hat{s}(n-i),\ n = 0, \ldots, N-1 \qquad \text{[Equation 2]}$$

where $\hat{S}(n)$ denotes the synthesized signal, $\hat{u}(n)$ denotes the excitation signal, and N denotes a magnitude of an encoding frame using the same order. The excitation signal may be determined using a sum of an adaptive codebook and a fixed codebook. A decoding apparatus may generate the synthesized signal using the decoded excitation signal and the quantized LPC coefficient.

The LPC coefficient may express formant information of a spectrum that is expressed as a spectrum peak, and may be used to encode an envelope of a total spectrum. In this instance, an encoding apparatus may convert the LPC coefficient to an ISF coefficient or an LSF coefficient in order to increase an efficiency of the LPC coefficient.

The ISF coefficient may prevent a divergence occurring due to quantization through simple stability verification. When a stability issue occurs, the stability issue may be solved by adjusting an interval of quantized ISF coefficients. The LSF coefficient may have the same characteristics as the ISF coefficient except that a last coefficient of LSF coefficients is a reflection coefficient, which is different from the ISF coefficient. The ISF or the LSF is a coefficient that is converted from the LPC coefficient and thus, may maintain formant information of the spectrum of the LPC coefficient alike.

Specifically, quantization of the LPC coefficient may be performed after converting the LPC coefficient to an immittance spectral pair (ISP) or a line spectral pair (LSP) that may have a narrow dynamic range, readily verify the stability, and easily perform interpolation. The ISP or the LSP may be expressed by the ISF coefficient or the LSF coefficient. A relationship between the ISF coefficient and the ISP or a relationship between the LSF coefficient and the LSP may be expressed by Equation 3.

$$q_i=\cos(\omega_i)\ n=0, \ldots, N-1 \quad \text{[Equation 3]}$$

where $q_i$ denotes the LSP or the ISP and $\omega_i$ denotes the LSF coefficient or the ISF coefficient. The LSF coefficient may be vector quantized for a quantization efficiency. The LSF coefficient may be prediction-vector quantized to enhance a quantization efficiency. When a vector quantization is performed, and when a dimension increases, a bitrate may be enhanced whereas a codebook size may increase, decreasing a processing rate. Accordingly, the codebook size may decrease through a multi-stage vector quantization or a split vector quantization.

The vector quantization indicates a process of considering all the entities within a vector to have the same importance, and selecting a codebook index having a smallest error using a squared error distance measure. However, in the case of LPC coefficients, all the coefficients have a different importance and thus, a perceptual quality of a finally synthesized signal may be enhanced by decreasing an error of an important coefficient. When quantizing the LSF coefficients, the decoding apparatus may select an optimal codebook index by applying, to the squared error distance measure, a weighting function that expresses an importance of each LPC coefficient. Accordingly, a performance of the synthesized signal may be enhanced.

According to one or more embodiments, a per-magnitude weighting function may be determined with respect to a substantial effect of each ISF coefficient or LSF coefficient given to a spectrum envelope, based on substantial spectrum magnitude and frequency information of the ISF coefficient or the LSF coefficient. In addition, an additional quantization efficiency may be obtained by combining a per-frequency weighting function and a per-magnitude weighting function. The per-frequency weighting function is based on a perceptual characteristic of a frequency domain and a formant distribution. Also, since a substantial frequency domain magnitude is used, envelope information of all frequencies may be well used, and a weight of each ISF coefficient or LSF coefficient may be accurately induced.

According to one or more embodiments, when an ISF coefficient or an LSF coefficient converted from an LPC coefficient is vector quantized, and when an importance of each coefficient is different, a weighting function indicating a relatively important entry within a vector may be determined. An accuracy of encoding may be enhanced by analyzing a spectrum of a frame desired to be encoded, and by determining a weighting function that may give a relatively great weight to a portion with a great energy. The spectrum energy being great may indicate that a correlation in a time domain is high.

Figure 3A:
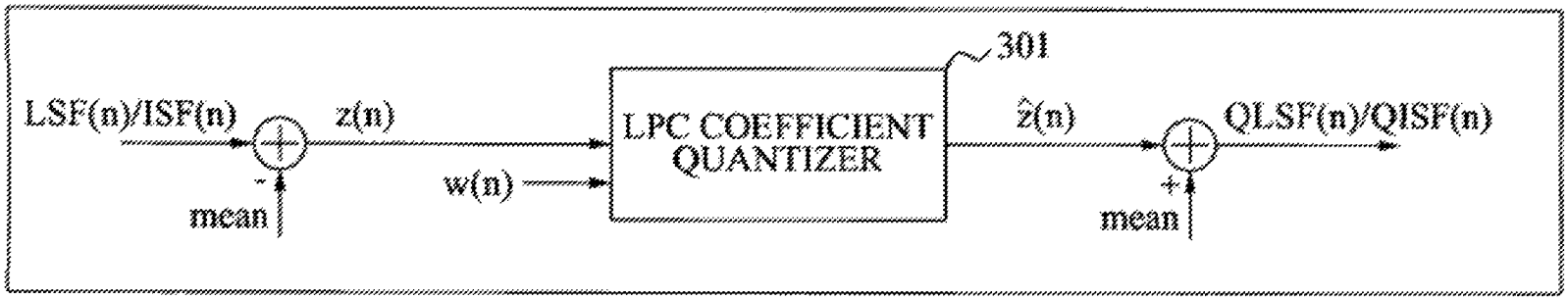
FIGS. 3A, 3B, and 3C illustrate a process of quantizing an LPC coefficient according to one or more embodiments.
Figure 3B:
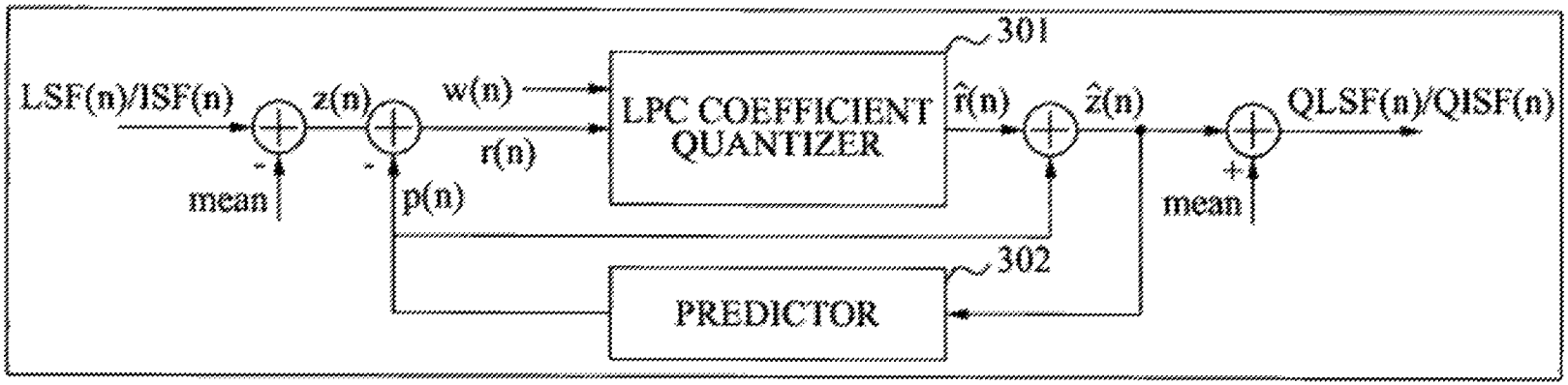
Figure 3C:
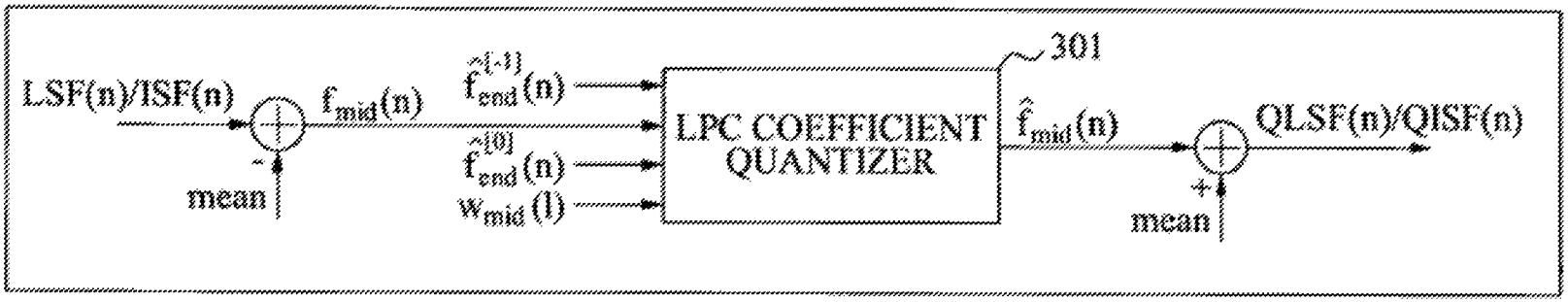

FIGS. 3A, 3B, and 3C illustrate a process of quantizing an LPC coefficient according to one or more embodiments.

FIGS. 3A, 3B, and 3C illustrate two types of processes of quantizing the LPC coefficient. FIG. 3A may be applicable when a variability of an input signal is small. FIG. 3A and FIG. 3B may be switched and thereby be applicable depending on a characteristic of the input signal. FIG. 3 illustrates a process of quantizing an LPC coefficient of a mid-subframe.

An LPC coefficient quantizer 301 may quantize an ISF coefficient using a scalar quantization (SQ), a vector quantization (VQ), a split vector quantization (SVQ), and a multi-stage vector quantization (MSVQ), which may be applicable to an LSF coefficient alike.

A predictor 302 may perform an auto regressive (AR) prediction or a moving average (MA) prediction. Here, a prediction order denotes an integer greater than or equal to '1'.

An error function for searching for a codebook index through a quantized ISF coefficient of FIG. 3A may be given by Equation 4. An error function for searching for a codebook index through a quantized ISF coefficient of FIG. 3B may be expressed by Equation 5. The codebook index denotes a minimum value of the error function.

An error function induced through quantization of a mid-subframe that is used in International Telecommunication Union Telecommunication Standardization sector (ITU-T) G.718 of FIG. 3C may be expressed by Equation 6. Referring to Equation. 6, an index of an interpolation weight set minimizing an error with respect to a quantization error of the mid-subframe may be induced using an ISF value $\hat{f}_{end}^{[0]}(n)$ that is quantized with respect to a frame-end of a current frame, and an ISF value $\hat{f}_{end}^{[-1]}(n)$ that is quantized with respect to a frame-end of a previous frame.

$$E_{werr}(k)=\sum_{n=0}^{p} w(n)[z(n)-c_z^k(n)]^2 \quad \text{[Equation 4]}$$

$$E_{werr}(p)=\sum_{i=0}^{p} w(i)[r(i)-c_r^p(i)]^2 \quad \text{[Equation 5]}$$

$$E_k^{[0]}(m)=\sum_{i=M_k}^{M_k+P_k-1} w_{mid}(l)\left[f_{mid}^{[0]}(l)-\left[(1-\alpha_k(m))\hat{f}_{end}^{[-1]}(l)+\alpha_k(m)\hat{f}_{end}^{[0]}(l)\right]\right]^2 \quad \text{[Equation 6]}$$

Here, w(n) denotes a weighting function, z(n) denotes a vector in which a mean value is removed from ISF(n), c(n) denotes a codebook, and p denotes an order of an ISF coefficient and uses 10 in a narrowband and 16 to 20 in a wideband.

According to one or more embodiments, an encoding apparatus may determine an optimal weighting function by combining a per-magnitude weighting function using a spectrum magnitude corresponding to a frequency of the ISF coefficient or the LSF coefficient that is converted from the LPC coefficient, and a per-frequency weighting function using a perceptual characteristic of an input signal and a formant distribution.

Figure 4:
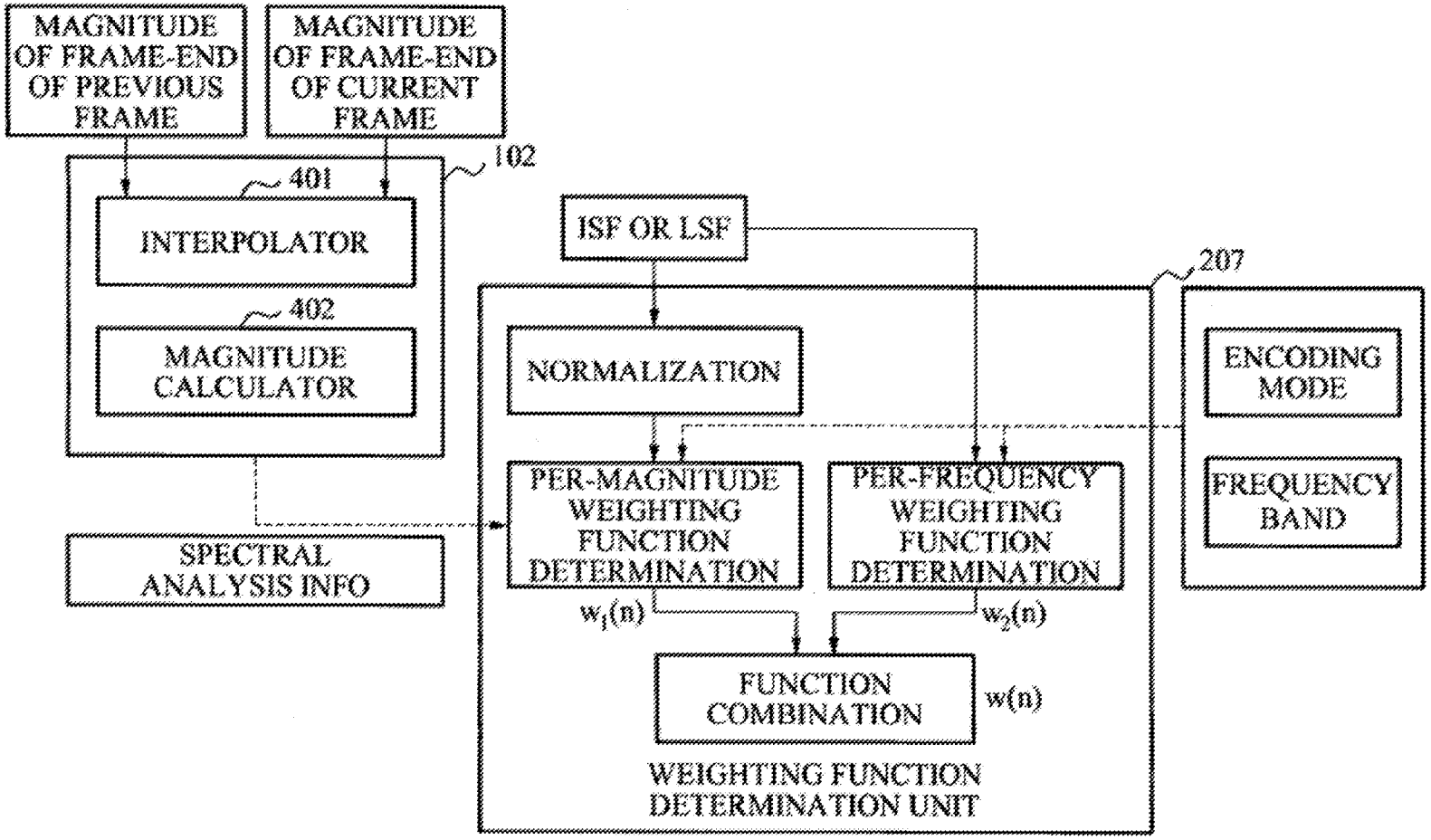
FIG. 4 illustrates a process of determining, by a weighting function determination unit of FIG. 2, a weighting function according to one or more embodiments.

FIG. 4 illustrates a process of determining, by the weighting function determination unit 207 of FIG. 2, a weighting function according to one or more embodiments.

FIG. 4 illustrates a detailed configuration of the spectrum analyzer 102. The spectrum analyzer 102 may include an interpolator 401 and a magnitude calculator 402.

The interpolator 401 may induce an interpolated spectrum magnitude of a mid-subframe by interpolating a spectrum magnitude with respect to a frame-end of a current frame and a spectrum magnitude with respect to a frame-end of a previous frame that are a performance result of the spectrum analyzer 102. The interpolated spectrum magnitude of the mid-subframe may be induced through a linear interpolation or a nonlinear interpolation.

The magnitude calculator 402 may calculate a magnitude of a frequency spectrum bin based on the interpolated spectrum magnitude of the mid-subframe. A number of frequency spectrum bins may be determined to be the same as a number of frequency spectrum bins corresponding to a range set by the weighting function determination unit 207 in order to normalize the ISF coefficient or the LSF coefficient.

The magnitude of the frequency spectrum bin that is spectral analysis information induced by the magnitude calculator 402 may be used when the weighting function determination unit 207 determines the per-magnitude weighting function.

The weighting function determination unit 207 may normalize the ISF coefficient or the LSF coefficient converted from the LPC coefficient of the mid-subframe. During this process, a last coefficient of ISF coefficients is a reflection coefficient and thus, the same weight may be applicable. The above scheme may not be applied to the LSF coefficient. In p order of ISF, the present process may be applicable to a range of 0 to p-2. To employ spectral analysis information, the weighting function determination unit 207 may perform a normalization using the same number K as the number of frequency spectrum bins induced by the magnitude calculator 402.

The weighting function determination unit 207 may determine a per-magnitude weighting function $W_1(n)$ of the ISF coefficient or the LSF coefficient affecting a spectrum envelope with respect to the mid-subframe, based on the spectral analysis information transferred via the magnitude calculator 402. For example, the weighting function determination unit 207 may determine the per-magnitude weighting function based on frequency information of the ISF coefficient or the LSF coefficient and an actual spectrum magnitude of an input signal. The per-magnitude weighting function may be determined for the ISF coefficient or the LSF coefficient converted from the LPC coefficient.

The weighting function determination unit 207 may determine the per-magnitude weighting function based on a magnitude of a frequency spectrum bin corresponding to each frequency of the ISF coefficient or the LSF coefficient.

The weighting function determination unit 207 may determine the per-magnitude weighting function based on the magnitude of the spectrum bin corresponding to each frequency of the ISF coefficient or the LSF coefficient, and a magnitude of at least one neighbor spectrum bin adjacent to the spectrum bin. In this instance, the weighting function determination unit 207 may determine a per-magnitude weighting function associated with a spectrum envelope by extracting a representative value of the spectrum bin and at least one neighbor spectrum bin. For example, the representative value may be a maximum value, a mean, or an intermediate value of the spectrum bin corresponding to each frequency of the ISF coefficient or the LSF coefficient and at least one neighbor spectrum bin adjacent to the spectrum bin.

For example, the weighting function determination unit 207 may determine a per-frequency weighting function $W_2(n)$ based on frequency information of the ISF coefficient or the LSF coefficient. Specifically, the weighting function determination unit 207 may determine the per-frequency weighting function based on a perceptual characteristic of an input signal and a formant distribution. The weighting function determination unit 207 may extract the perceptual characteristic of the input signal by a bark scale. The weighting function determination unit 207 may determine the per-frequency weighting function based on a first formant of the formant distribution.

As one example, the per-frequency weighting function may show a relatively low weight in an extremely low frequency and a high frequency, and show the same weight in a predetermined frequency band of a low frequency, for example, a band corresponding to the first formant.

The weighting function determination unit 207 may determine a final weighting function by combining the per-magnitude weighting function and the per-frequency weighting function. The weighting function determination unit 207 may determine the final weighting function by multiplying or adding up the per-magnitude weighting function and the per-frequency weighting function.

As another example, the weighting function determination unit 207 may determine the per-magnitude weighting function and the per-frequency weighting function based on an encoding mode of an input signal and frequency band information, which will be further described with reference to FIG. 5.

Figure 5:
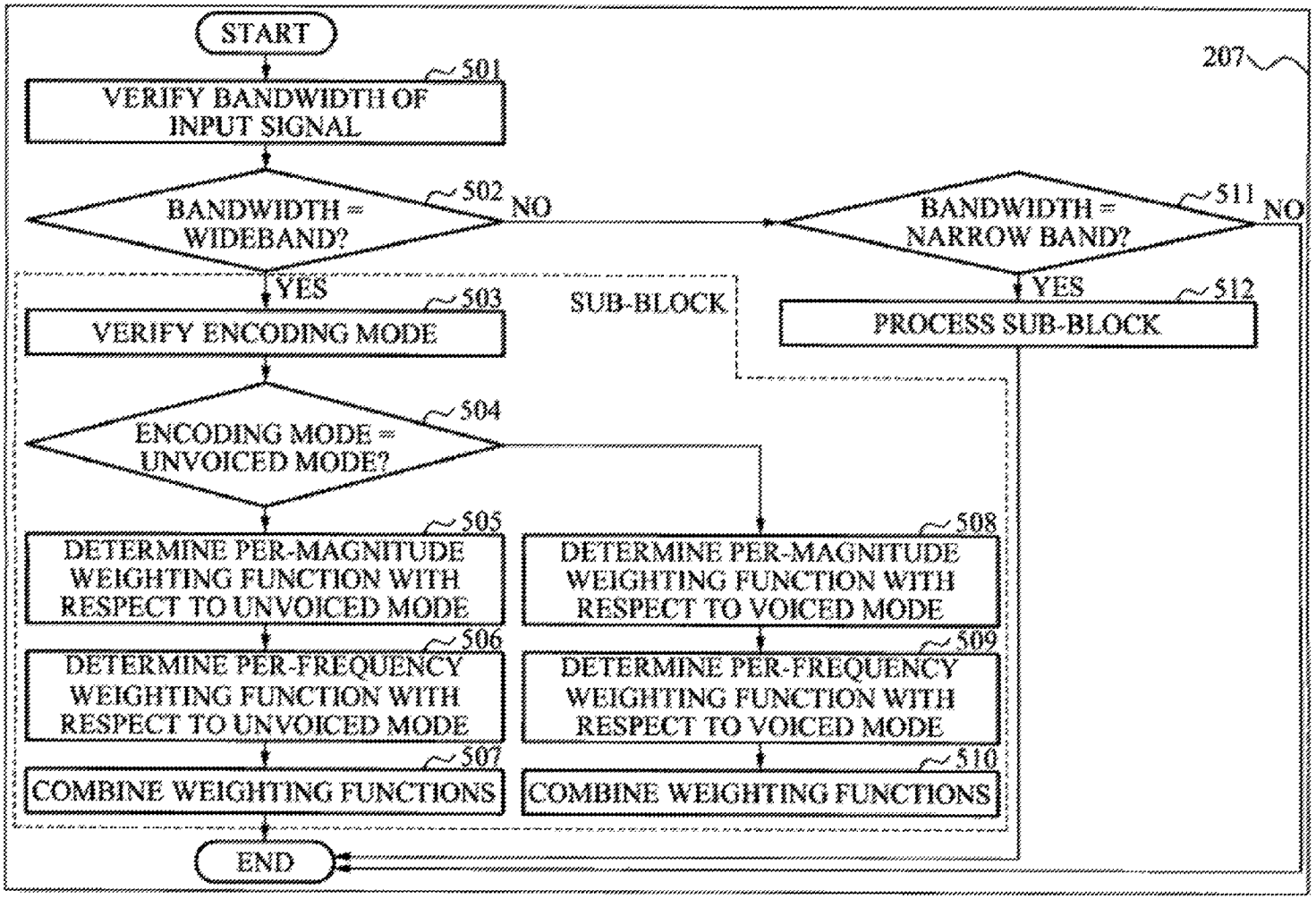
FIG. 5 illustrates a process of determining a weighting function based on an encoding mode and bandwidth information of an input signal according to one or more embodiments.

FIG. 5 illustrates a process of determining a weighting function based on encoding mode and bandwidth information of an input signal according to one or more embodiments.

In operation 501, the weighting function determination unit 207 may verify a bandwidth of an input signal. In operation 502, the weighting function determination unit 207 may determine whether the bandwidth of the input signal corresponds to a wideband. When the bandwidth of the input signal does not correspond to the wideband, the weighting function determination unit 207 may determine whether the bandwidth of the input signal corresponds to a narrowband in operation 511. When the bandwidth of the input signal does not correspond to the narrowband, the weighting function determination unit 207 may not determine the weighting function. Conversely, when the bandwidth of the input signal corresponds to the narrowband, the weighting function determination unit 207 may process a corresponding sub-block, for example, a mid-subframe based on the bandwidth, in operation 512 using a process through operation 503 through 510.

When the bandwidth of the input signal corresponds to the wideband, the weighting function determination unit 207 may verify an encoding mode of the input signal in operation 503. In operation 504, the weighting function determination unit 207 may determine whether the encoding mode of the input signal is an unvoiced mode. When the encoding mode of the input signal is the unvoiced mode, the weighting function determination unit 207 may determine a per-magnitude weighting function with respect to the unvoiced mode in operation 505, determine a per-frequency weighting function with respect to the unvoiced mode in operation 506, and combine the per-magnitude weighting function and the per-frequency weighting function in operation 507.

Conversely, when the encoding mode of the input signal is not the unvoiced mode, the weighting function determination unit 207 may determine a per-magnitude weighting function with respect to a voiced mode in operation 508, determine a per-frequency weighting function with respect to the voiced mode in operation 509, and combine the per-magnitude weighting function and the per-frequency weighting function in operation 510. When the encoding mode of the input signal is a generic mode or a transition mode, the weighting function determination unit 207 may determine the weighting function through the same process as the voiced mode.

For example, when the input signal is frequency converted according to a fast Fourier transform (FFT) scheme, the per-frequency weighting function using a spectrum magnitude of an FFT coefficient may be determined according to Equation 7.

$$W_1(n)=(3\cdot\sqrt{w_f(n)-\text{Min}}+2.\ \text{Min=Minimum value of } w_f(n) \quad \text{[Equation 7]}$$

Where, $w_f(n)=10\ \log(\max(E_{bin}(\text{norm_isf}(n)),\ E_{bin}(\text{norm_isf}(n)+1),\ E_{bin}(\text{norm_isf}(n)-1))$, for, $n=0, \ldots, M-2$, $1\leq\text{norm_isf}(n)\leq126$ $w_f(n)=10\ \log(E_{bin}(\text{norm_isf}(n)))$, for, $\text{norm_isf}(n)=0$ or 127

$\text{norm_isf}(n)=\text{isf}(n)/50$, then, $0\leq\text{isf}(n)\leq6350$, and $0\leq\text{norm_isf}(n)\leq127$ $$E_{BIN}(k)=X_R^2(k)+X_I^2(k), k=0, \ldots, 127$$

Figure 6:
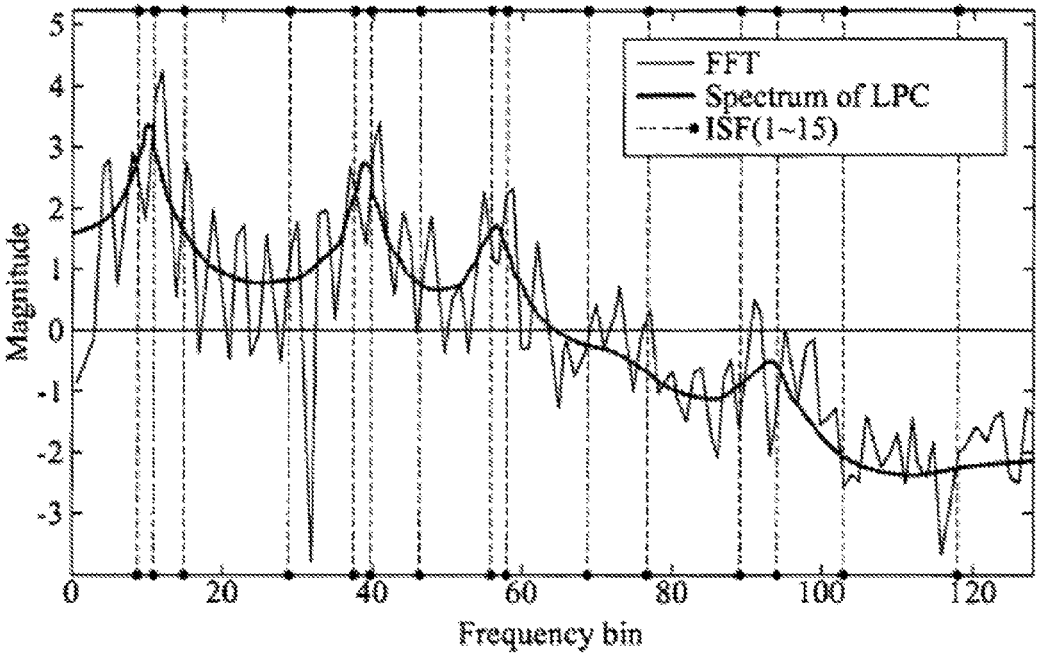
FIG. 6 illustrates an immittance spectral frequency (ISF) obtained by converting an LPC coefficient according to one or more embodiments.

FIG. 6 illustrates an ISF obtained by converting an LPC coefficient according to one or more embodiments.

Specifically, FIG. 6 illustrates a spectrum result when an input signal is converted to a frequency domain according to an FFT, the LPC coefficient induced from a spectrum, and an ISF coefficient converted from the LPC coefficient. When 256 samples are obtained by applying the FFT to the input signal, and when 16 order linear prediction is performed, 16 LPC coefficients may be induced, the 16 LPC coefficients may be converted to 16 ISF coefficients.

Figure 7A:
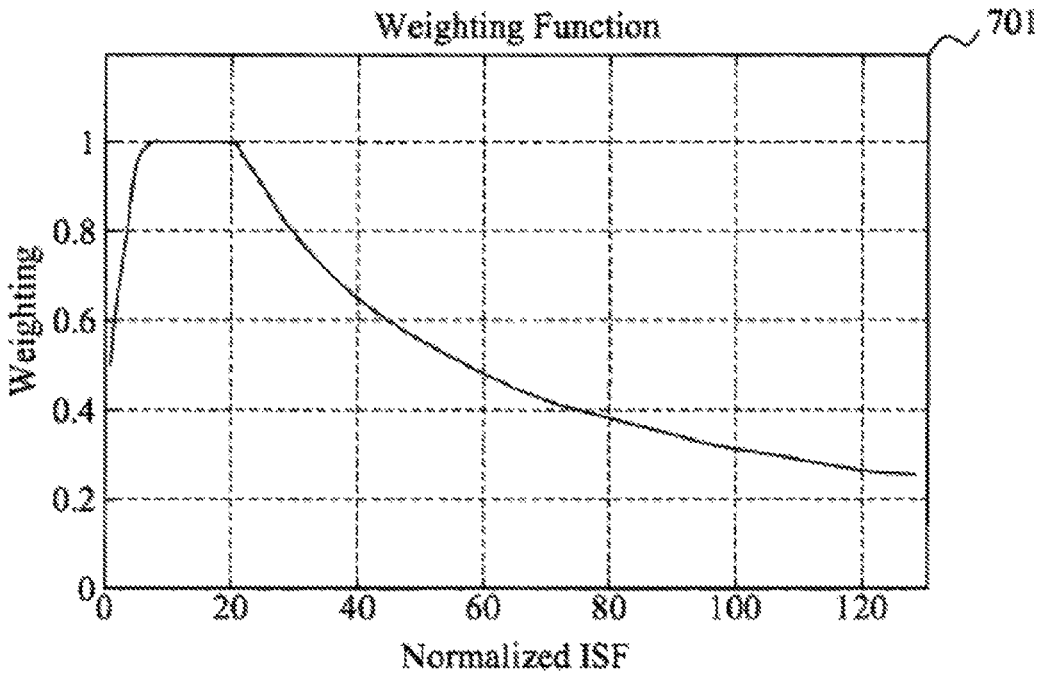
FIGS. 7A and 7B illustrate a weighting function based on an encoding mode according to one or more embodiments.
Figure 7B:
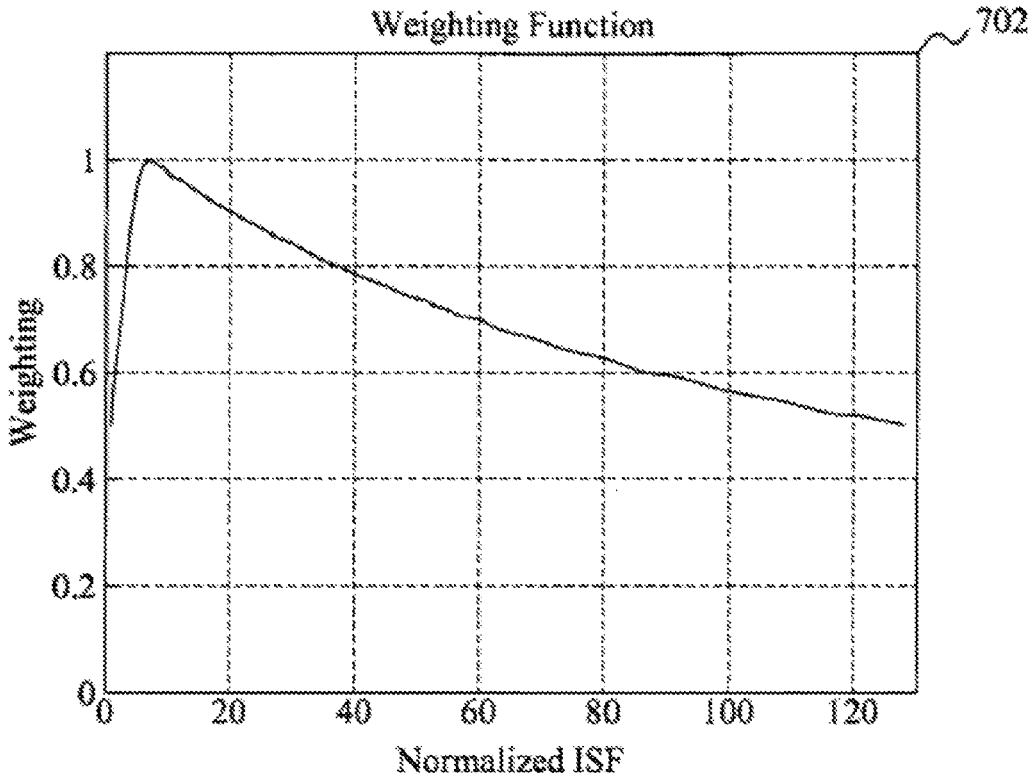

FIGS. 7A and 7B illustrate a weighting function based on an encoding mode according to one or more embodiments.

Specifically, FIGS. 7A and 7B illustrate a per-frequency weighting function that is determined based on the encoding mode of FIG. 5. FIG. 7A illustrates a graph 701 showing a per-frequency weighting function in a voiced mode, and FIG. 7B illustrates a graphing 702 showing a per-frequency weighting function in an unvoiced mode.

For example, the graph 701 may be determined according to Equation 8, and the graph 702 may be determined according to Equation 9. A constant in Equation 8 and Equation 9 may be changed based on a characteristic of the input signal.

$$W_2(n) = 0.5 + \frac{\sin\left(\frac{\pi\cdot\text{norm_isf}(n)}{12}\right)}{2}, \quad \text{[Equation 8]}$$

For, $\text{norm_isf}(n) = [0, 5]$ $W_2(n) = 1.0$ For, $\text{norm_isf}(n) = [6, 20]$ $$W_2(n) = \frac{1}{\left(\frac{4*(\text{norm_isf}(n)-20)}{107}+1\right)},$$

For, $\text{norm_isf}(n) = [21, 127]$

-continued $$W_2(n) = 0.5 + \frac{\sin\left(\frac{\pi\cdot\text{norm_isf}(n)}{12}\right)}{2}, \quad \text{[Equation 9]}$$

For, $\text{norm_isf}(n) = [0, 5]$ $$W_2(n) = \frac{1}{\left(\frac{(\text{norm_isf}(n)-6)}{121}+1\right)},$$

For, $\text{norm_isf}(n) = [6, 127]$

A weighting function finally induced by combining the per-magnitude weighting function and the per-frequency weighting function may be determined according to Equation 10.

$$W(n)=W_1(n)\cdot W_2(n), \text{ for } n=0, \ldots, M-2$$

$$W(M-1)=1.0 \quad \text{[Equation 10]}$$

Figure 8:
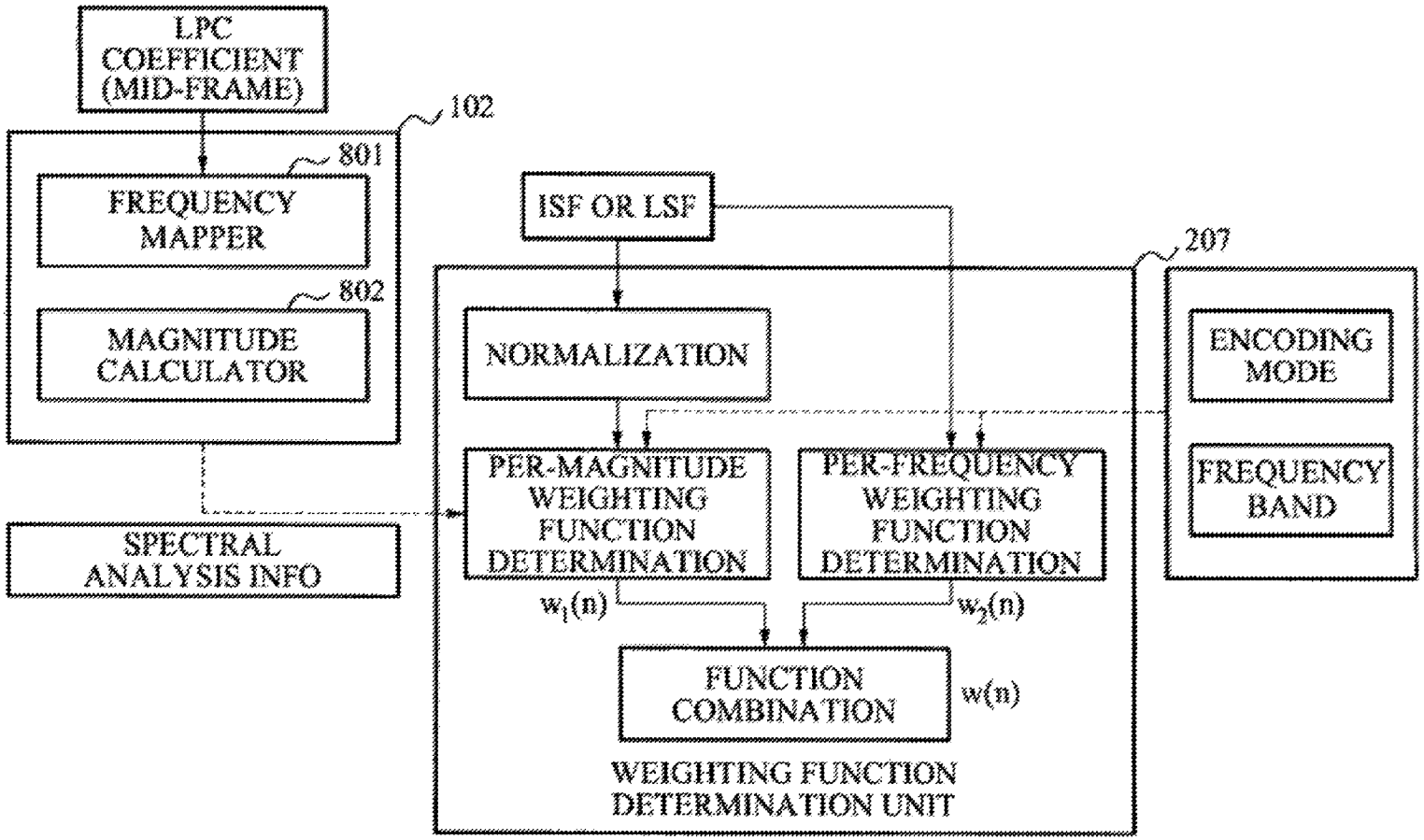
FIG. 8 illustrates a process of determining, by the weighting function determination unit of FIG. 2, a weighting function according to other one or more embodiments.

FIG. 8 illustrates a process of determining, by the weighting function determination unit 207 of FIG. 2, a weighting function according to other one or more embodiments.

FIG. 8 illustrates a detailed configuration of the spectrum analyzer 102. The spectrum analyzer 102 may include a frequency mapper 801 and a magnitude calculator 802.

The frequency mapper 801 may map an LPC coefficient of a mid-subframe to a frequency domain signal. For example, the frequency mapper 801 may frequency-convert the LPC coefficient of the mid-subframe using an FFT, a modified discrete cosine transform (MDST), and the like, and may determine LPC spectrum information about the mid-subframe. In this instance, when the frequency mapper 801 uses a 64-point FFT instead of using a 256-point FFT, the frequency conversion may be performed with a significantly small complexity. The frequency mapper 801 may determine a frequency spectrum magnitude of the mid-subframe using LPC spectrum information.

The magnitude calculator 802 may calculate a magnitude of a frequency spectrum bin based on the frequency spectrum magnitude of the mid-subframe. A number of frequency spectrum bins may be determined to be the same as a number of frequency spectrum bins corresponding to a range set by the weighting function determination unit 207 to normalize an ISF coefficient or an LSF coefficient.

The magnitude of the frequency spectrum bin that is spectral analysis information induced by the magnitude calculator 802 may be used when the weighting function determination unit 207 determines a per-magnitude weighting function.

A process of determining, by the weighting function determination unit 207, the weighting function is described above with reference to FIG. 5 and thus, further detailed description will be omitted here.

Figure 9:
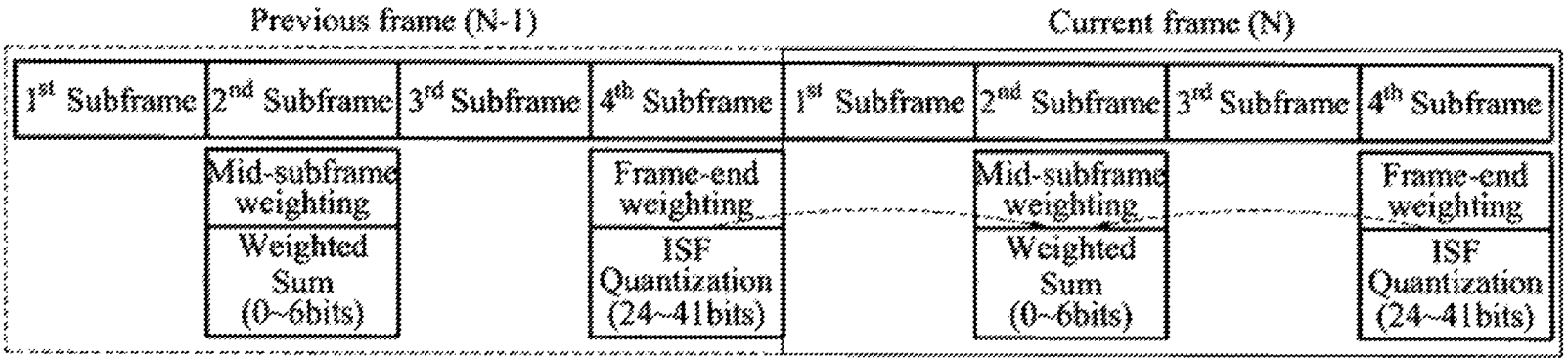
FIG. 9 illustrates an LPC encoding scheme of a mid-subframe according to one or more embodiments.

FIG. 9 illustrates an LPC encoding scheme of a mid-subframe according to one or more embodiments.

A CELP encoding technology may use an LPC coefficient with respect to an input signal and an excitation signal. When the input signal is encoded, the LPC coefficient may be quantized. However, in the case of quantizing the LPC coefficient, a dynamic range may be wide and a stability may not be readily verified. Accordingly, the LPC coefficient may be converted to an LSF (or an LSP) coefficient or an ISF (or an ISP) coefficient of which a dynamic range is narrow and of which a stability may be readily verified.

In this instance, the LPC coefficient converted to the ISF coefficient or the LSF coefficient may be vector quantized for efficiency of quantization. When the quantization is performed by applying the same importance with respect to all the LPC coefficients during the above process, a deterioration may occur in a quality of a finally synthesized input signal. Specifically, since all the LPC coefficients have a different importance, the quality of the finally synthesized input signal may be enhanced when an error of an important LPC coefficient is small. When the quantization is performed by applying the same importance without using an importance of a corresponding LPC coefficient, the quality of the input signal may be deteriorated. A weighting function may be used to determine the importance.

In general, a voice encoder for communication may include 5 ms of a subframe and 20 ms of a frame. An AMR and an AMR-WB that are voice encoders of a Global system for Mobile Communication (GSM) and a third Generation Partnership Project (3GPP) may include 20 ms of the frame consisting of four 5 ms-subframes.

As shown in FIG. 9, LPC coefficient quantization may be performed each one time based on a fourth subframe (frame-end) that is a last frame among subframes constituting a previous frame and a current frame. An LPC coefficient for a first subframe, a second subframe, and a third subframe of the current frame may be determined by interpolating a quantized LPC coefficient with respect to a frame-end of the previous frame and a frame-end of the current frame.

According to one or more embodiments, an LPC coefficient induced by performing linear prediction analysis in a second subframe may be encoded for a sound quality enhancement. The weighting function determination unit 207 may search for an optimal interpolation weight using a closed loop with respect to a second frame of a current frame that is a mid-subframe, using an LPC coefficient with respect to a frame-end of a previous frame and an LPC coefficient with respect to a frame-end of the current frame. A codebook index minimizing a weighted distortion with respect to a 16 order LPC coefficient may be induced and be transmitted.

A weighting function with respect to the 16 order LPC coefficient may be used to calculate the weighted distortion. The weighting function to be used may be expressed by Equation 11. According to Equation 11, a relatively great weight may be applied to a portion with a narrow interval between ISF coefficients by analyzing an interval between the ISF coefficients.

$$w_i = 3.347 - \frac{1.547}{450} d_i \quad \text{for } d_i < 450, \qquad \text{[Equation 11]}$$
$$= 1.8 - \frac{0.8}{1050}(d_i - 450) \quad \text{otherwise}$$
$$d_i = f_{i+1} - f_{i-1}$$

A low frequency emphasis may be additionally applied as shown in Equation 12. The low frequency emphasis corresponds to an equation including a linear function.

$$w_{mid}(n) = \frac{14-n}{14} w_{tmp}(n) + w_{tmp}(n), \quad n = 0, \ldots, 14 \qquad \text{[Equation 12]}$$
$$w_{mid}(15) = 2.0$$

According to one or more embodiments, since a weighting function is induced using only an interval between ISF coefficients or LSF coefficients, a complexity may be low due to a significantly simple scheme. In general, a spectrum energy may be high in a portion where the interval between ISF coefficients is narrow and thus, a probability that a corresponding component is important may be high. However, when a spectrum analysis is substantially performed, a case where the above result is not accurately matched may frequently occur.

Accordingly, proposed is a quantization technology having an excellent performance in a similar complexity. A first proposed scheme may be a technology of interpolating and quantizing previous frame information and current frame information. A second proposed scheme may be a technology of determining an optimal weighting function for quantizing an LPC coefficient based on spectrum information.

The above-described embodiments may be recorded in non-transitory computer-readable media including computer readable instructions such as a computer program to implement various operations by executing computer readable instructions to control one or more processors, which are part of a general purpose computer, a computing device, a computer system, or a network. The media may also have recorded thereon, alone or in combination with the computer readable instructions, data files, data structures, and the like. The computer readable instructions recorded on the media may be those specially designed and constructed for the purposes of the embodiments, or they may be of the kind well-known and available to those having skill in the computer software arts. The computer-readable media may also be embodied in at least one application specific integrated circuit (ASIC) or Field Programmable Gate Array (FPGA), which executes (processes like a processor) computer readable instructions. Examples of non-transitory computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of computer readable instructions include both machine code, such as produced by a compiler, and files containing higher level code that may be executed by the computer using an interpreter. The described hardware devices may be configured to act as one or more software modules in order to perform the operations of the above-described embodiments, or vice versa. Another example of media may also be a distributed network, so that the computer readable instructions are stored and executed in a distributed fashion.

Although embodiments have been shown and described, it would be appreciated by those skilled in the art that changes may be made in these embodiments without departing from the principles and spirit of the disclosure, the scope of which is defined by the claims and their equivalents.

What is claimed is:

1. An apparatus for encoding a signal at least one of speech and audio, the apparatus comprising:

at least one processing device configured to:

obtain a linear predictive coefficient (LPC) vector of a subframe from a current frame of the signal;

obtain a line spectral frequency (LSF) vector of the subframe from the LPC vector of the subframe;

normalize the LSF vector based on a number of spectral bins in the subframe; and determine a weighting function of the subframe by combining a first weighting function based on the magnitude of the spectral bin corresponding to the normalized LSF vector and a second weighting function based on frequency information for the normalized LSF vector, wherein the frequency information comprises formant distribution of the signal.

2. The apparatus of claim 1, wherein the weighting function is based on the magnitude of the spectral bin corresponding to the frequency of the normalized LSF vector and the magnitude of at least one neighboring spectral bin.

3. The apparatus of claim 1, wherein the weighting function is based on a maximum value of the magnitude of the spectral bin corresponding to the frequency of the normalized LSF vector and the magnitude of at least one neighboring spectral bin.

4. The apparatus of claim 1, wherein the spectral bins are obtained from time to frequency mapping of the signal.

5. The apparatus of claim 4, wherein the time to frequency mapping is performed by using a Fast Fourier Transform.

6. The apparatus of claim 1, wherein the second weighting function is based on at least one of a bandwidth and a coding mode of the signal.

7. The apparatus of claim 1, wherein the frequency information further comprises perceptual characteristics.

8. The apparatus of claim 1, wherein the subframe is either a mid-subframe or a frame-end subframe in the current frame.

* * * * *